US005257741A

United States Patent [19]

Rode et al.

[11] Patent Number: 5,257,741

[45] Date of Patent: Nov. 2, 1993

[54] METHOD AND APPARATUS FOR CONTAINER REDEMPTION AND RECYCLING

[76] Inventors: Jerry A. Rode, 1023 Pine NW.; Brian C. Rode, 1023 Pine NW. Apt. #2, both of Grand Rapids, Mich. 49504

[21] Appl. No.: 948,093

[22] Filed: Sep. 21, 1992

[51] Int. Cl.[5] ..... B02C 19/12

[52] U.S. Cl. ..... 241/24; 241/100; 241/DIG. 38

[58] Field of Search ..... 241/99, 100, DIG. 38, 241/24

[56] References Cited

U.S. PATENT DOCUMENTS

| | | | |
|---|---|---|---|
| 3,749,004 | 7/1973 | Pagdin et al. | 100/50 |
| 3,857,334 | 12/1974 | Arp | 100/53 |
| 4,013,497 | 3/1977 | Wolf | 156/154 |
| 4,088,072 | 5/1978 | Wittmeier . | |
| 4,285,426 | 8/1981 | Cahill | 194/4 |
| 4,324,325 | 4/1982 | De Woolfson . | |
| 4,345,679 | 8/1982 | De Woolfson . | |
| 4,373,435 | 2/1983 | Grevich . | |
| 4,440,284 | 4/1984 | De Woolfson . | |
| 4,469,212 | 9/1984 | De Woolfson et al. . | |
| 4,492,295 | 1/1985 | De Woolfson . | |
| 4,573,641 | 3/1986 | DeWoolfson et al. | 241/36 |
| 4,579,216 | 4/1986 | De Woolfson et al. . | |
| 4,784,251 | 11/1988 | De Woolfson et al. . | |
| 4,827,840 | 5/1989 | Kane . | |
| 4,925,117 | 5/1990 | Ramos | 241/236 |
| 4,962,701 | 10/1990 | Stralow . | |
| 4,976,196 | 12/1990 | Phillips et al. . | |
| 4,989,507 | 2/1991 | Rhoades et al. . | |
| 5,009,155 | 4/1991 | Christianson . | |
| 5,033,375 | 7/1991 | Reeves . | |
| 5,038,677 | 8/1991 | Whittman et al. . | |
| 5,092,234 | 3/1992 | Von Rohr . | |
| 5,094,157 | 3/1992 | Challis et al. . | |
| 5,165,610 | 11/1992 | Pendelton | 241/79 |

*Primary Examiner*—Irene Cuda
*Assistant Examiner*—John M. Husar
*Attorney, Agent, or Firm*—Basile and Hanlon

[57] ABSTRACT

An apparatus and method is disclosed for redeeming returnable containers inserted by a customer. Each returnable container has a longitudinal axis and uniform product code data on an external peripheral surface. The apparatus includes a conveying device for transporting individual containers from a first location for customer insertion to a second location for selective container ejection and a third location for selective container shredding. A spinning device imparts rotation to the individual containers while passing between the first and second locations, preferably causing the uniform product code data to travel in a helical path for multiple reads by a scanning device prior to reaching the second location. The scanning device sends an output signal to a central processing unit for processing in accordance with a control program stored in memory. Processed electronic output signals are generated by the central processing unit to control an ejector mechanism if the scanning device does not read recognizable uniform product code data from the container. If recognizable uniform product code data is read by the scanning device and verified by the central processing unit, the container passes onto shredding gears located at the third location. Consumer transaction counters and vendor transaction counters are incremented for each container accepted for shredding by the apparatus. A receipt can be generated for the customer after a single or after multiple container transactions have taken place. Vendor transaction data is stored to allow retrieval of historical vendor transaction data on a periodic basis.

20 Claims, 5 Drawing Sheets

METHOD AND APPARATUS FOR CONTAINER REDEMPTION AND RECYCLING

FIELD OF THE INVENTION

The present invention relates to a method and apparatus for receiving returnable containers, dispensing a coupon, receipt or token to the customer depositing the returnable container, shredding the container into recyclable strips, and compiling and storing data regarding returned containers for subsequent retrieval.

BACKGROUND OF THE INVENTION

In the past several years, industry, government and the public have shown renewed interest in returnable containers, like cans and bottles. Such interest arises largely from increasing concerns for ecology, energy efficiency, and economy. Many ecologists advocate a requirement that all containers be returnable because of the ecologists, belief that redeemable containers are less likely to be discarded as litter. In addition, with advanced technology, it now takes less energy to recycle certain materials from old containers than it does to use raw materials. Recycled materials have also become more economical than certain raw materials because of the rapidly increasing costs of mining.

The most common mechanism for inducing consumers to return beverage containers is an economic reward for such return. This reward is typically either a deposit refunded to the consumers when empty containers are returned, or else money paid to consumers who return empty containers. Many states have taken legislative action to require a deposit to induce return of empty containers. These states, known as "mandatory deposit" states, generally require the container distributors or vendors to charge retailers a certain amount per container and require the retailers in turn to charge their customers a deposit, usually a nickel or a dime, for each container sold. When the consumers in the mandatory deposit states return the empty containers, the retailers must refund the deposit. Each distributor or vendor in the mandatory deposit states must then collect from the retailer all the returned containers having that distributor's brands and must pay back to the retailers the deposits plus handling fees. Such handling fees generally range from one to two cents per container.

Although simple at face value, the laws in mandatory deposit states present substantial practical problems for retailers and distributors. Since the distributors are required to collect only their own brands from retailers, the retailers must first sort all the returned beverage containers manually and then store the sorted containers for pickup by the appropriate distributor. This system causes retailers manpower problems due to sorting, and space and sanitation problems due to the storage of the containers.

A further problem which retailers face in mandatory deposit states is delay in receiving reimbursement from distributors. After returning the deposits to their customers, retailers must wait until the distributors collect the containers and their accounting staffs process the collection paperwork to get the money back for those deposits. Seldom do the one to two cents per container handling fees compensate for this delay or for the retailers' other costs.

Distributors also have major problems in mandatory deposit states. They must commit additional facilities, manpower and trucks to handle the return and disposition of the empty containers, and they must coordinate their full goods operations with the handling of empties. The distributors also have large problems with accounting and container count verification, as do retailers.

In "voluntary deposit" states, where the retailer is not required to take back empty beverage containers, problems also exist. Recycling in these states is driven by the desire of container producers, as well as by heavy users of container materials made of aluminum and glass. to recover and recycle the materials in those containers. Unlike mandatory deposit states, most programs involved in voluntary deposit states take place in coordination with these container producers. The accounting problems, however, are still significant for the sellers of beverages in returnable containers.

The recovery of used aluminum for its scrap value is an established industry and the recovery and reuse of glass is gaining popularity. Traditional methods of aluminum recovery generally involve collection and delivery of recovered metal to scrap yards. As aluminum's value increases and as Bauxite, which is the ore from which aluminum is smelted, becomes more expensive to import, many manufacturers of aluminum containers have developed more concentrated recycling efforts. Such efforts, however, are generally manual.

Certain companies have, in response to these problems, developed reverse vending machines. One type of reverse vending machine called a bulk feed machine, is placed in a shopping center parking lot. Generally, bulk feed machines only determine whether returned cans are non-ferrous, and if so, the machines pay according to weight. Such machines are used in voluntary deposit states.

Another type of reverse vending machine is a single feed device which is typically placed inside stores. Single feed devices typically reimburse consumers for return of the proper type of containers (i.e., aluminum cans). These devices usually do not attempt to perform any accounting beyond the counting of the total number of containers processed.

While reverse vending machines offer some improvement over purely manual methods of container redemption, the accounting and storage problems described above still remain. In addition, the sorting, space and sanitation problems of the retailers remain, as well as the problems of the distributors in transporting and handling empties.

It is desirable in the present invention to alleviate, or greatly reduce, the problems associated with the accounting, manpower and storage problems that distributors and retailers currently have in redeeming returnable containers. It is further desirable in the present invention to alleviate, or greatly reduce, the transportation and handling costs of empty containers. It is yet a further desirable characteristic of the present invention to facilitate the collection of the required accounting data into an easily retrievable form.

SUMMARY OF THE INVENTION

The present invention is an apparatus for redeeming returnable containers inserted by a customer. Each returnable container has a longitudinal axis and uniform product code data on a circumferential external surface of the container. The apparatus includes conveying means for transporting individual containers from a first location of customer insertion to a second location for selective container ejection and a third location for selective container shredding. Spinning means is provided for imparting rotation to the container about the longitudinal axis while passing between the first and second locations. Scanning means is provided adjacent the conveying means between the first and second locations for reading the uniform product code data from the circumferential external surface of the container as the container spins. The scanning means sends an output signal corresponding to the uniform product code data. Central processing means receive the output signal and process the output signal in accordance with a control program stored in memory. The central processing means generates a processed electronic output signal in accordance with the control program. Ejecting means, responsive to the processed electronic output signal, is provided for rejecting the container as the container passes through the second location, when the scanning means fails to read recognizable uniform product code data from the container. Shredding means are disposed at the third location for shredding the container when the scanning means reads recognizable uniform product code data from the container.

The apparatus according to the present invention may also include customer transaction counter means for processing multiple containers in a single transaction from a single customer. The apparatus may also include vendor transaction counter means for compiling the total number of containers shredded for each vendor identified by the uniform product code data read from the circumferential external surface of the container by the scanning means. Data storage means may also be provided for temporary and long term storage of the control program, customer transaction counter data and vendor transaction counter data. After completion of a customer transaction, the customer may request a receipt indicating the total number of containers accepted for shredding during the transaction. The receipt may take the form of a printed receipt, token, coin or coupon indicating the number of accepted containers that have been shredded by the apparatus. After generating the receipt for the customer, the customer transaction counter means is reset to zero. Based on the uniform product code data read by the scanning means, the appropriate vendor transaction counter is incremented to indicate each container accepted for shredding by the apparatus from that particular vendor. Periodically, a representative of the vendor may request a receipt in printed, electronic or magnetic form summarizing customer transactions corresponding to containers from the vendor as identified by a predefined vendor code portion of the uniform product code data read from the circumferential external surface of the containers inserted by the customers. After successful delivery of the selected data corresponding to the vendor, the vendor transaction counter is preferably not reset to zero for that vendor, instead the vendor data is accumulated for at least 12 months to provide each vendor with a cumulative 12 month total and a cumulative 30 day total that can be reported on a day by day basis. Preferably, each vendor or vendor's representative will be required to input or supply a security code or key before being able to access the container data. Vendors have indicated a willingness to accept the container data as proof of a container return for accounting purposes, since this procedure can reduce the vendor's cost associated with transporting and handling the empty containers. The shredded containers may be disposed of for scrap value by the retailer. The scrap value can correspondingly increase the revenue available to the retailer for handling the empty containers, while reducing the manpower required to sort the empty containers, and simultaneously reducing, or eliminating, the problems associated with storage space for the empty containers and any associated sanitation problems.

In operation, the apparatus for redeeming returnable containers inserted by a customer includes the steps of receiving individual containers within a container conveyor means, transporting the individual containers from a first location for customer drop-off to a second location for selective container ejection and to a third location for selective container shredding. As the container is transported from the first location to the second location, the container is spun about the longitudinal axis. Preferably, in addition, force is imparted to the container to further movement of the container along the path of the conveyor means. Uniform product code data disposed on an external circumferential surface of the container is sensed by scanning means while the container is spinning. If uniform product code data is sensed by the scanning means, the uniform product code data is processed by central processing means in accordance with a program stored in memory. The uniform product code data is preferably verified by at least one additional scanning read of the uniform product code data prior to the uniform product code data moving downstream of the scanning means. The sensed uniform product code data is preferably compiled on a consumer transaction basis, and compiled on a vendor transaction basis. The total number of containers accepted for shredding by the apparatus are stored according vendor code and date of receipt for subsequent selective retrieval and/or processing. If the uniform product code data is sensed and verified, the container is transported to the third location for shredding. If the uniform product code data is not sensed within a predetermined time period, the central processing means in accordance with the program stored in memory sends a processed electronic output signal to the ejector means for ejecting the container prior to delivery to the third location, so that the container is deposited in a rejection location for subsequent customer retrieval.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED AND ALTERNATIVE EMBODIMENTS

Figure 1:
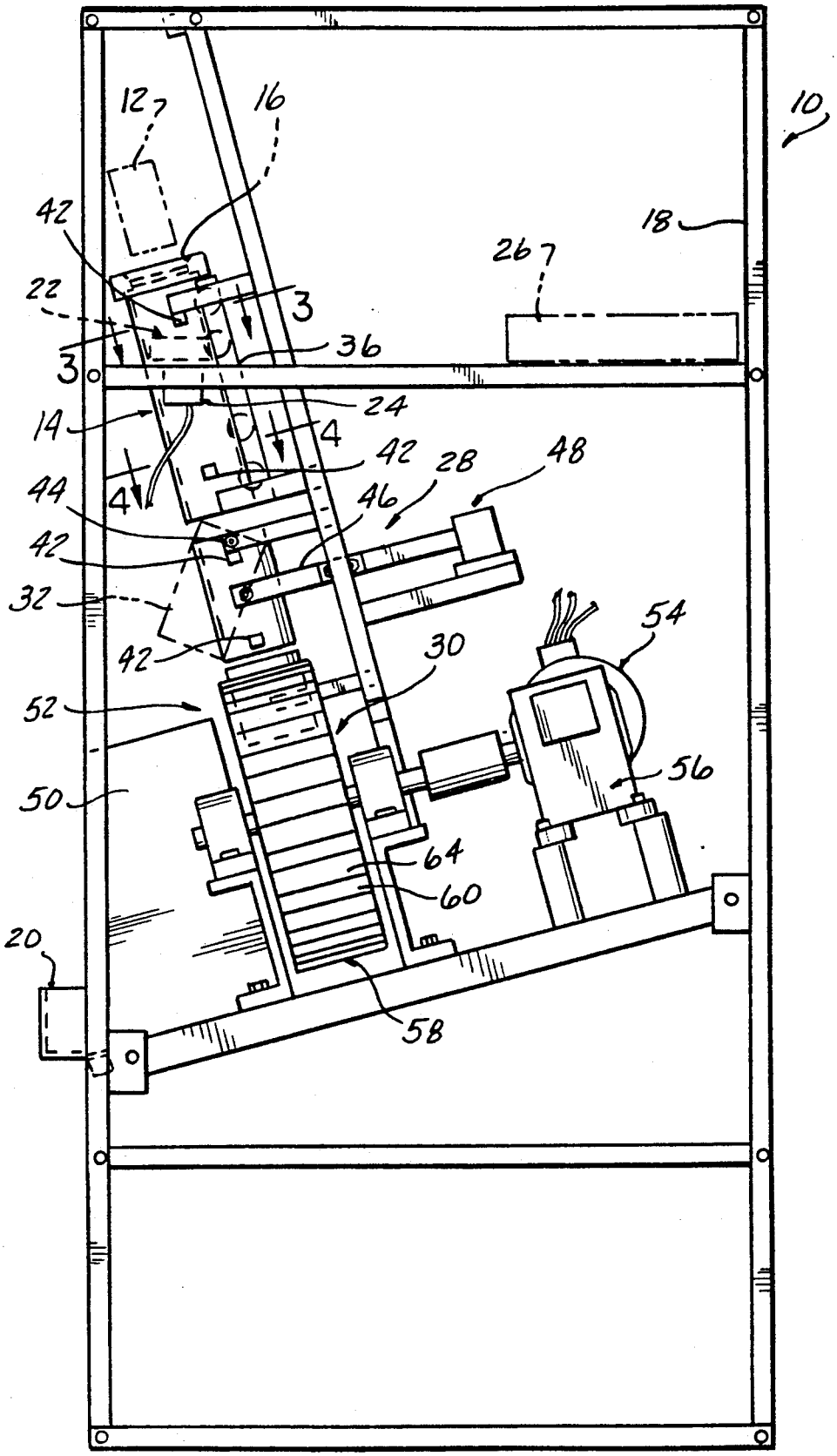
FIG. 1 a side elevational view of an apparatus for redeeming returnable containers inserted by a customer with the exterior panels removed.
Figure 2:
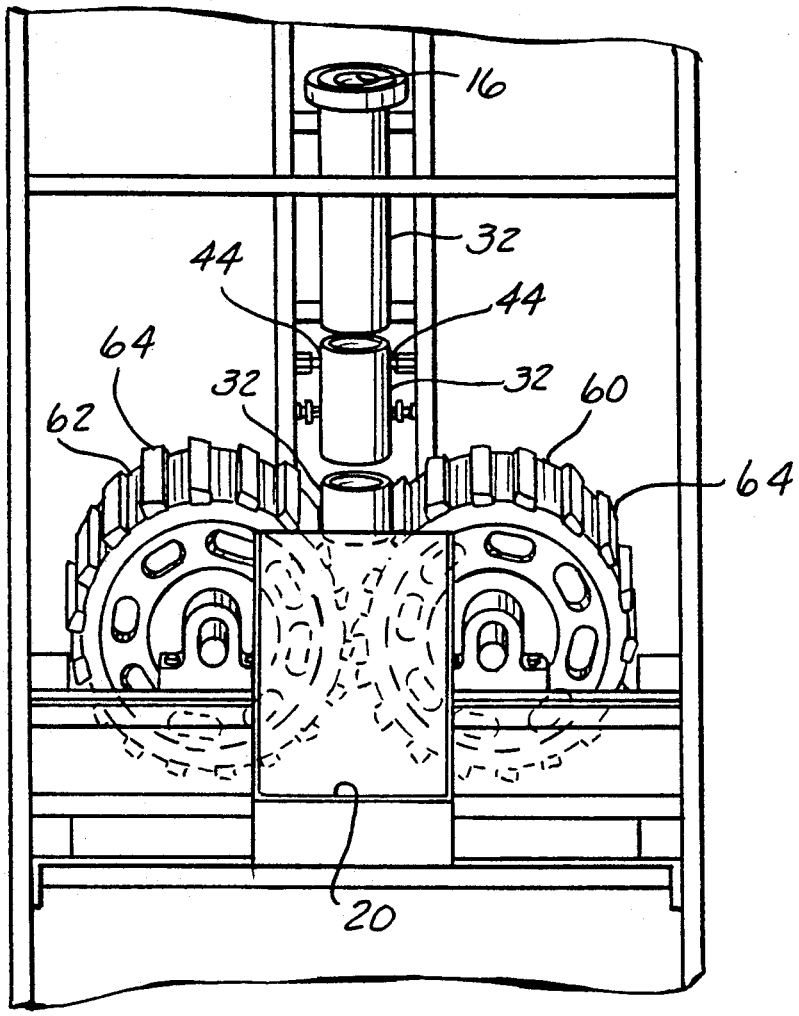
FIG. 2 is a front elevational view of the apparatus shown in FIG. 1.

Referring now to FIGS. 1 and 2, an apparatus, generally designated as 10, for redeeming returnable containers according to the present invention is depicted in side and front elevational view, respectively. The containers 12, typically take the form of returnable aluminum beverage containers or cans, have a longitudinal axis and uniform product code data on an external circumferential surface of the container. Of course, it should be recognized that the present invention can be modified to accommodate containers made of different materials, provided that the containers have a longitudinal axis and a circumferential external surface carrying uniform product code data. Containers 12 are individually inserted into conveyor means 14 through opening 16 located at one end of the elongated conveyor means 14. The apparatus is shown in FIGS. 1 and 2 with the external panels removed, and with various parts shown in phantom or removed for clarity. During use external panels would be attached to the frame 18 to enclose the working components of the apparatus 10. The opening 16 would be visible to the customer and accessible by the customer for insertion of the cans individually one by one. A second opening 20 would also be visible and accessible by the customer for retrieving rejected containers that had previously been deposited in opening 16. For proper operation of the present invention, it is desirable to have the returnable containers 12 in a generally cylindrical uncrushed state. Containers 12 that have been crushed sufficiently to prevent proper operation of the device will be ejected and returned through the reject opening 20 for manual processing. After being inserted within the conveyor means 14, the container 12 is driven in rotation about its longitudinal axis by spinning means 22. Preferably, spinning means 22 is disposed at an angle with respect to the path of the container through the conveying means 14, such that both rotational and longitudinal movement is imparted to the container 12. Imparting both rotational and longitudinal movement to the container 12 moves the portion of the external circumferential surface of the container carrying the uniform product code data in a helical trajectory longitudinally along the path of the conveying means 14. The conveying means 14 transports individual containers from a first location for customer insertion of the containers, such as circular opening 16, to a second location for selective container ejection and a third location for selective container shredding. The spinning means 22 is disposed adjacent the conveying means 14 between the first and second locations. Scanning means 24 is positioned adjacent the conveying means 14 between the first and second locations for reading the uniform product code data from the external surface of the container while spinning. Preferably, the scanning means 24 reads the uniform product code data at least two times while traveling through the helical path between the first and second locations. The scanning means sends an output signal corresponding to the uniform product code data read from the external surface of the container 12. Central processing means, shown in phantom at 26 receive the output signal from the scanning means and process the output signal in accordance with a control program stored in memory. The central processing means 26 generates a processed electronic output signal in accordance with the control program. Ejector means 28 is provided at the second location along the path of the conveying means 14. The ejector means 28 is responsive to the processed electronic output signal generated by the central processing means 26 for rejecting a container. The container 12 is rejected when the scanning means 24 fails to read recognizable uniform product code data from the circumferential external surface of the container 12 and is ejected from the apparatus as the container passes through the second location. Shredding means 30 is provided at the third location for shredding a container when the scanning means 24 is able to read recognizable uniform product code data from the circumferential external surface of the container 12.

Referring now to FIGS. 1–4, in the preferred configuration, the conveying means 14 of the present invention includes an elongated generally cylindrical or tubular member 32 separated into three longitudinally separated, normally coaxially aligned, sections. The first or upper section of the elongated cylindrical member 32 includes roller means 34 equally angularly spaced about the longitudinal axis of the elongated cylindrical member 32, as can best be seen in FIG. 4. The roller means 34 preferably includes a longitudinally extending roller housing 36, as best seen in FIG. 1, for supporting and partially enclosing a plurality of rollers 38. Each roller 38 has a rotational axis generally normal to a radius extending outwardly from the longitudinal axis of the elongated cylindrical member 32 that bisects the length of the roller 38. In other words, the rotational axes of the rollers 38 define three tangential lines of an imaginary circle radially spaced from, and having a center coaxial with, the longitudinal axis of the elongated cylindrical member 32. The external surfaces of the roller 38 extend inwardly through apertures formed in the side wall of the elongated cylindrical member 32 to engage the external peripheral surface of the container 12, as shown in phantom in FIGS. 3 and 4. Rollers of this type are available from Kingston-Warren Corporation located in Newfields, New Hampshire as Kingway Roll Trak Section. The rollers typically are $1\frac{1}{8}''$ rollers on two inch centers. The first or upper section of the elongated cylindrical member 32 includes circular opening 16 for receiving the containers 12 individually on a one by one basis.

Figure 3:
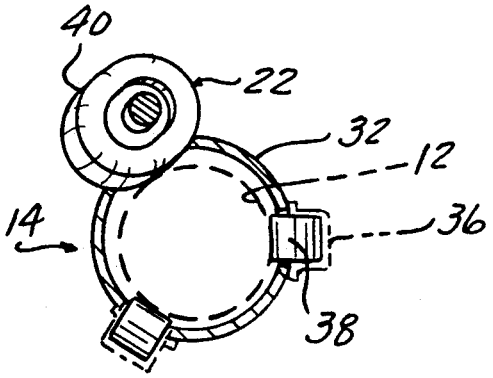
FIG. 3 is a cross sectional view of the container conveyor means taken as shown in FIG. 1.
Figure 4:
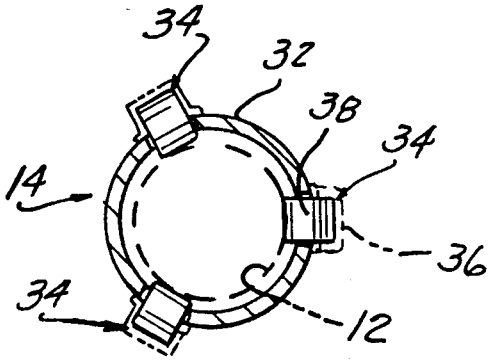
FIG. 4 is a cross sectional view of the container conveyor means taken as shown in FIG. 1.

While passing through the first section of the elongated cylindrical member 32, the container 12 is supported by the plurality of rollers 38 and, as best seen in FIG. 3, engages spinning means 22. The spinning means 22 preferably includes a drive roller 40, such as a semi-pneumatic tire. The drive roller 40 replaces one of the rollers 38 and is disposed preferably at an angle with respect to a plane normal to the longitudinal axis of the elongated cylindrical member 32, such that as the drive roller 40 is driven in rotation, contact between the drive roller 40 and the external circumferential surface of the container 12 imparts spin to the container 12 about the longitudinal axis of the container 12, while simultaneously imparting longitudinal movement to the container 12 toward the second or middle section of the elongated cylindrical member 32. The rotational and longitudinal movement imparted to the container 12 drives a portion of the external cylindrical surface of the container 12 containing the uniform product code data along a helical path. Scanning means 24 is generally disposed downstream of the drive roller 40 and is of sufficient size to read the uniform product code data from the external surface of the container 12 at least two times while passing the scanning means 24. Preferably, the scanning means 24 can read 200 scans per second. When a four inch diameter semipneumatic tire is used as drive roller 40 and is disposed at an 11°angle with respect to a plane normal to the longitudinal axis of the elongated cylindrical member 32 and is driven in rotation at 200 revolutions per minute, the scanning means 24 can read the uniform product code data at least five times before passing downstream of the scanning means. A scanner meeting these specifications is available from Allen-Bradley located in Milwaukee, Wisconsin, and is sold as Model Nos. 2755-DSIA and 2755-LDB. The scanning means 24 sends an output signal corresponding to the uniform product code data.

In the preferred embodiment, sensor means 42 is disposed adjacent each end of the first and second sections of the elongated cylindrical member 32. The sensor means 42 can include a photoelectric sensor for sending a signal when a container 12 passes the photoelectric sensor. Suitable photoelectric sensors are available as manufactured by Allen-Bradley located in Milwaukee, Wisconsin, sold as Series 7020 Type 42SMP. The first sensor located along the longitudinal path of the container 12 through the conveying means 14 senses the container 12 as it is inserted through the circular opening 16. A signal is sent from the first photoelectric sensor to the central processing means 26 to indicate that an output signal from the scanner means 24 should be received prior to triggering of the second photoelectric sensor disposed at the opposite end of the first section of the elongated cylindrical member 32. If uniform product code data is received from the scanning means 24 and verified by the microprocessor means 26, the container 12 is allowed to pass straight through the first, second and third sections of the elongated cylindrical member 32 for shredding. If recognizable uniform product code data is not received from the scanner means 24 by the central processing means 26 before the second photoelectric sensor is triggered, the central processing means 26 sends a processed output signal to activate the ejecting means 28.

Third and fourth sensor means 42 are disposed adjacent opposite ends of the second section of the elongated cylindrical member 32. These additional photoelectric sensors ensure that the ejector mean 28 is activated while the rejected container 12 is positioned between the two longitudinal ends of the second section of the elongated cylindrical member 32. Preferably, the second section of the elongated cylindrical member 32 is pivotally connected to frame 18 about pivot point 44. A pivotal link 46 is connected at one end to the second section of the elongated cylindrical member 32 downstream of the pivot point 44 and is connected at an opposite end to motor means 48, such as an electric operated solenoid. The combination of the pivot point 44, pivotal link 46 and motor means 48 act to move the second section of the elongated cylindrical member 32 from a first position coaxial with the first and third sections of the elongated cylindrical member 32 to a second position (shown in phantom) directing discharge from the second section of the elongated cylindrical member 32 into the reject chute 50. The reject chute 50 communicates with the reject opening 20 in the front of the apparatus. Preferably, the motor means 48 normally holds the second section of the elongated cylindrical member 32 in its coaxial first position, and pivots the second section to the second position when energized in response to the processed electronic output signal from the central processing means 26. Movement of the second section of the elongated cylindrical member 32 while the container is within the second section changes the normal coaxial path of the container 12 to a new path having a trajectory sufficient to deposit the container 12 within the reject chute 50 for subsequent retrieval of the rejected container 12 by the customer through reject opening 20.

If recognizable uniform product code data is read by scanning means 24 and verified by central processing means 26, the container 12 is allowed to continue along the normal path coaxially through the first, second and third sections of the elongated cylindrical member 32. The third section of the elongated cylindrical member 32 directs the container 12 into the shredding means 52. The shredding means 52 shreds the containers 12 into recyclable strips to reduce storage space.

The shredding means 52 preferably includes second motor means 54 for driving a shaft in rotation when energized in response to processed electronic output signals from the central processing means 26. Motor means 54 preferably acts through gear reduction means 56. The gear reducing means 56 may have a three to two reduction ratio for driving gear means 58 at approximately 38 revolutions per minute. The gear means 58 may include two counter-rotating, intermeshing cog gears 60 and 62, respectively. The gear means 58 includes intermeshing teeth 64 disposed in line with the longitudinal axis of the elongated cylindrical member 32. After passing through the third or lower section of the elongated cylindrical member 32 as viewed in FIG. 2, the container 12 is drawn into the intermeshing teeth as the teeth 64 converge toward the longitudinal axis of the elongated cylinder 32. Preferably, the teeth 64 are removable and replaceable independently of one another for ease of maintenance. Both gears 62 and 64 are driven in rotation by the motor mean 54 through intermeshing contact of teeth 64. After passing through the intermeshing gears 60 and 62, the shredded strips of the container 12 fall downwardly as viewed in FIG. 1 and 2 and can be deposited in a bin (not shown) located in the lower portion of the frame 18, or can be deposited on a conveyor system (not shown) for transfer to a large storage container for pick up by an appropriate recycling company.

Figure 5:
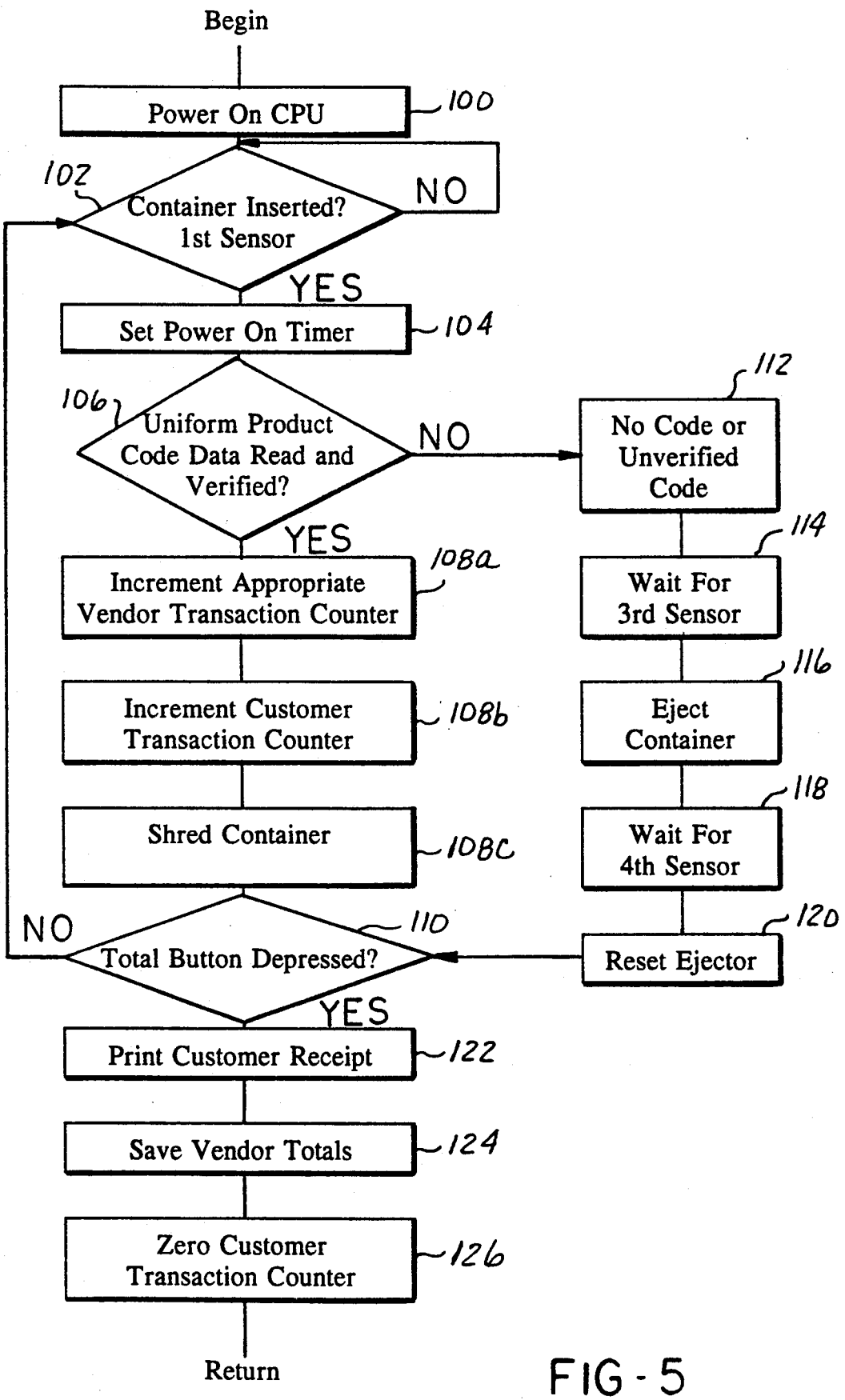
FIG. 5 is a flow diagram showing the operation of the apparatus.
Figure 6:
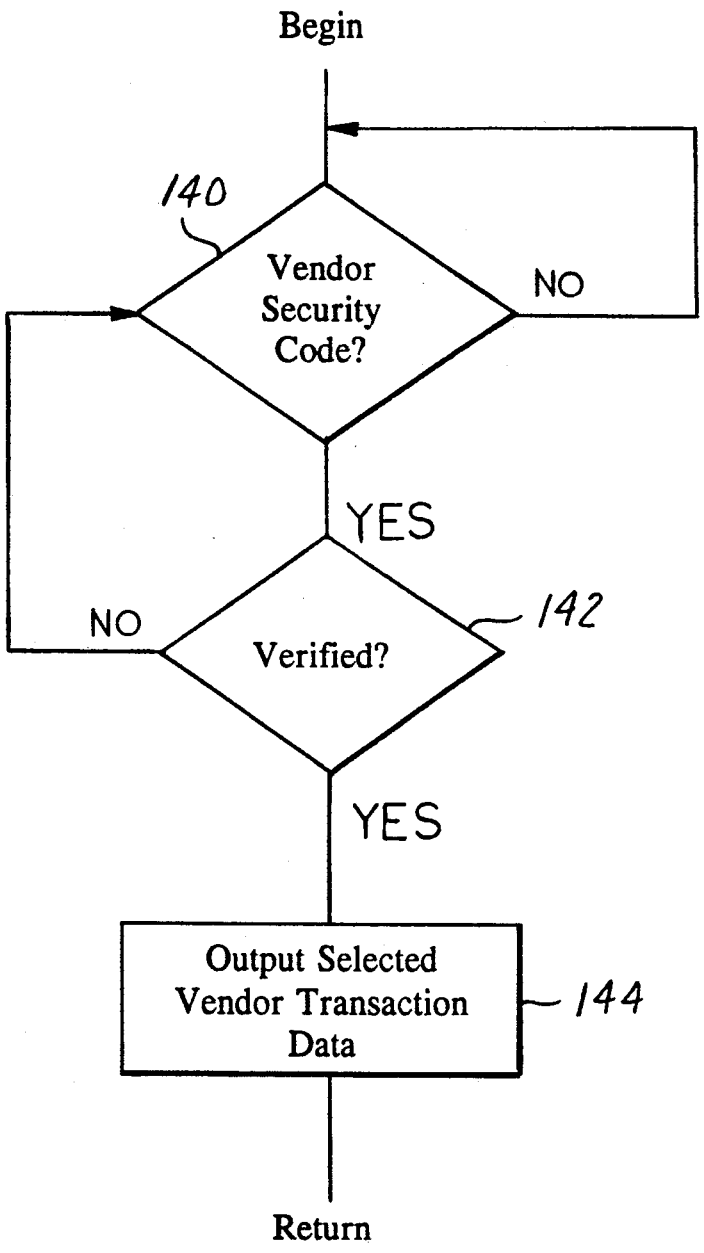
FIG. 6 a flow diagram showing the subroutine for selective retrieval of vendor transaction data.
Figure 7:
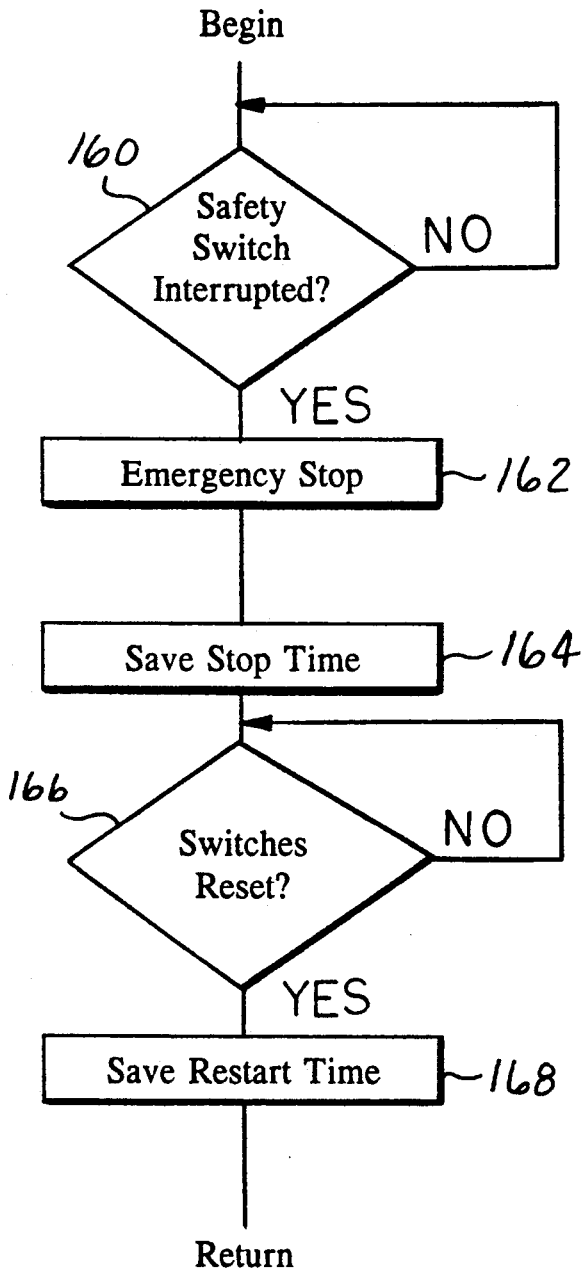
FIG. 7 is a flow diagram showing the subroutine for recording entry into the interior of the apparatus housing for security purposes and for turning off power to the apparatus if an external panel is removed.

Referring now to FIGS. 5–7, the operation of the apparatus 10 is shown in flow diagrams. More specifically in FIG. 5, the primary operation of the apparatus is depicted beginning with power being supplied to the central processing means 26 or central processing unit (CPU) as indicated at 100. The central processing unit monitors whether a container 12 has been inserted through opening 16 by the signal received from the first sensor 42 positioned adjacent the upper end of the first section of the elongated cylindrical member 32 as indicated at 102. The query at 102 is repeated continuously until a yes response is received by the central processing unit causing flow of the program to continue to 104 where a timer is set for a predetermined time period to supply power to activate the spinning means 22, scanning means 24 and crushing means 52.

Control then passes to query step 106, where the central processing unit is waiting to receive and verify recognizable uniform product code data read by the scanner means 24 as the external peripheral surface of the container 12 carrying the uniform product code data is helically driven past the scanner means 24 by spinning means 22. If recognizable uniform product code data is read by the scanning means 24 and verified by the central processing unit, preferably by comparison with a second read of the uniform product code data by the scanning means 24, the central processing unit increments the appropriate vendor transaction counter for the daily total of the particular vendor corresponding to the vendor code portion of the uniform product code data read from the external surface of the container 12. In addition, the central processing unit increments the customer transaction counter to total the number of containers inserted by a single customer during the customer transaction with the apparatus 10 as indicated in steps 108*a* through 108*c*. Control of the device then passes to query 110 where the central processing unit determines whether a total button has been depressed by the customer to indicate the end of this customer transaction. If the total button is not depressed, the program returns to query 102 for insertion of another container 12.

Returning back to the query at step 106, if the scanning means 24 is unable to read the uniform product code data on the external surface of the container 12, or the uniform product code data that is read is not verifiable by the central processing unit, prior to activation of the second sensor 42 located at the lower end of the first section of the elongated cylindrical member 32, the control branches as shown to step 112 as indicated in FIG. 5. The central processing unit then waits for actuation of the third sensor 42 located at the upper end of the second section of the elongated cylindrical container 32 indicating that the container 12 has entered into the second section of the elongated cylindrical container 32. After receiving the appropriate signal from the third sensor 42, the central processing unit through the appropriate output signal activates the ejector means 28 to move the second section of the elongated cylindrical member 32 from the first coaxial position to the second position diverting the rejected container 12 into the reject chute 50 for withdrawal by the customer from aperture 20 as indicated at 114 and 116 of the flow control diagram. The central processing unit then waits for a signal from the fourth sensor 42 located at the lower end of the second section of the elongated cylindrical member 32 as indicated at 118 of the flow diagram. Activation of the fourth sensor 42 indicates that the container 12 has cleared the second section of the elongated cylindrical member 32. The central processing unit then, through the appropriate signal, deenergizes the ejector means 28 to return the second section of the elongated cylindrical member 32 from the second position back to the coaxial first position, as indicated in step 120 of the flow diagram.

Control of the apparatus 10 then returns to the query indicated at 110 to determine if the customer has depressed the total button to indicate the end of the customer transaction. If the total button is not depressed, control returns to the query at 102 as previously indicated. If the total button is depressed, control of the apparatus 10 continues to 122 where a customer receipt is printed, or tokens or coins are dispersed to the customer in an amount corresponding to the total number of containers 12 recorded by the customer transaction counter for this transaction. The customer transaction counter indicates the cumulative total of containers 12 accepted for shredding by the apparatus 10. As indicated at 124, the central processing unit then saves the vendor transaction counter totals under the appropriate date to a permanent memory device, such as a hard disk. The customer transaction counter is then reset to zero as indicated at 126 before returning to the query at 102 where the central processing unit waits for the next container to be inserted.

Referring now to FIG. 6, a flow diagram depicts a data transfer subroutine for outputting selected vendor transaction data corresponding to predefined vendor security codes. As indicated at query 140, the central processing unit waits for vendor security code input. When a vendor security code is received through an input device, such as a security card reader, electronic input keypad, or other security code receiving device, the central processing unit verifies the code received from the input device against a vendor security code table stored in memory. If not verified, control returns from verification query 142 to vendor security code input query 140. If the vendor security code is verified, control passes to 144, where vendor transaction data corresponding to the vendor security code received is output through an output device. Preferably, data is downloaded to a 3½-inch diskette. However, it should be recognized that other methods of data output can be employed, such as a printout, electronic transmission to local or remote processing equipment, such as by modem or the like. Preferably, the data provided includes the current date and time, the vendor transaction counter totals grouped by date, with a cumulative total for the last twelve months and a cumulative total for the last thirty days. Data more than twelve months old may be deleted by the central processing unit. Only data corresponding to the particular vendor security code received during input would be provided to the output device. Upon completion of the data output, control returns to the query at 140 while the central processing unit waits for input of another vendor security code through the appropriate input device.

Referring now to FIG. 7, a second security and maintenance subroutine is provided which is also active at all times of operation of the apparatus 10, as is the case with the data transfer subroutine shown in FIG. 6. At query 160, the central processing unit waits for a yes response to the question whether any safety or panel switches have been interrupted. If the answer is yes, the central processing unit sends out an emergency stop to the spinning means 22, scanning means 24, and crushing means 52 as indicated at 162. Control then passes to 164 where the central processing unit saves the time of the emergency stop to a permanent memory device, such as a hard drive. Control then passes to the query at 166, where the central processing unit determines whether all switches have been reset. When the answer to this query is yes, control passes to 168 where the central processing unit saves the time of the reset to the permanent memory device, such as the hard drive. This information can be used to ascertain whether improper entry and tampering has occurred which may invalidate vendor transaction data that was entered during the time when the access panel to the apparatus 10 was opened or during the time when some other safety switch was interrupted. Control then returns to the query at 116 to await the next safety switch interrupt.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for redeeming returnable containers inserted by a customer, said returnable containers having a longitudinal axis and uniform product code data on an external surface, the apparatus comprising:

conveying means for transporting individual containers from a first location for customer insertion, to a second location for selective container ejection and to a third location for selective container shredding, the conveying means transporting said container along a fixed path aligned with said longitudinal axis of said container;

single means for driving the uniform product code data in a generally helical path along the fixed path;

scanning means disposed adjacent said conveying means between said first and second locations for reading said uniform product code data from said external surface of said container and for sending an output signal corresponding to said uniform product code data;

ejecting means for ejecting said container from said fixed path, as said container passes through said second location, when said scanning means fails to read recognizable uniform product code data from said external surface of said container; and shredding means for shredding said container at said third location, when said scanning means reads recognizable uniform product code data from said external surface of said container.

2. The apparatus of claim 1 wherein said single means further comprises:

spinning means for imparting rotation to said container about said longitudinal axis while passing between said first and second locations.

3. The apparatus of claim 2 wherein said spinning means further comprises:

an enlarged rotatably driven roller extending radially inwardly through said conveying means for engaging said external surface of said container, the driven roller disposed at an angle with respect to a plane normal to said conveying means for imparting both rotation and longitudinal movement to said container within said conveying means such that said uniform product code data follows a generally helical path between the driven roller and the second location.

4. The apparatus of claim 1 further comprising:

central processing means for receiving and processing said output signal in accordance with a control program stored in memory and for generating a processed electronic output signal to control said ejecting means.

5. The apparatus of claim 4 wherein said central processing means further comprises:

a central processing unit for comparing two output signals corresponding to two separate individual reads by said scanning means of said uniform product code data from the external surface of said container for identicalness, and if not identical, the central processing unit for sending a processed electronic output signal to actuate the ejecting means.

6. The apparatus of claim 1 wherein said conveyor means further comprises:

an elongated, hollow cylindrical member having open ends and divided into first, second and third sections, the first section having a circular aperture for receiving individual containers from said customer, one at a time, in an orientation with said longitudinal axis of said container coaxial with the hollow cylindrical member, the second section connected for movement between a first position coaxial with the first and third sections and a second position out of alignment with the first and third sections, and the third section having a discharge aperture for directing said container into contact with said shredding means.

7. The apparatus of claim 6 wherein said conveying means further comprises:

roller means for rollingly engaging said external surface of said container as said container moves through the hollow cylindrical member, said roller means connected to said cylindrical member at equal angularly spaced locations around a periphery of said cylindrical member and extending longitudinally along a portion of the cylindrical member.

8. The apparatus of claim 1 wherein said scanning means further comprises:

a scanner for reading uniform product code data at least two times from said external surface of said container as said container moves longitudinally along the fixed path between the first and second locations.

9. The apparatus of claim 1 wherein said ejecting means further comprises:

a moveable member for diverting rejected containers from said fixed path, the moveable member operable between a first position in line with said fixed path and a second position out of alignment with said fixed path.

10. The apparatus of claim 1 wherein said shredding means further comprises:

a pair of counter-rotating cog gears having intermeshing teeth aligned with the fixed path for shredding containers discharged at the third location, each gear having an axis of rotation generally perpendicular to and offset from the fixed path.

11. An apparatus for redeeming returnable containers inserted by a customer, said returnable containers having a longitudinal axis and unfirm product code data on an external surface, the apparatus comprising:

conveying means for transporting individual containers from a first location for customer insertion, to a second location for selective container ejection and to a third location for selective container shredding;

container drive means for simultaneously imparting both rotational and longitudinal movement to each container to drive the uniform product code data in a generally helical path along the fixed path while passing between said first and second locations;

scanning means disposed adjacent said conveying means between said container drive means and said second location for reading said uniform product code data from said external surface of said container while heroically spinning and for sending an output signal corresponding to said uniform product code data;

central processing means for receiving and processing said output signal in accordance with a control program stored in memory and for generating a processed electronic output signal;

ejecting means responsive to said processed electronic output signal for ejecting said container as said container passes through said second location when said scanning means fails to read recognizable uniform product code data from said external surface of said container; and shredding means for shredding said container at said third location when said scanning means reads recognizable uniform product code data from said external surface of said container.

12. The apparatus of claim 11 wherein said conveyor means further comprises:

an elongated, hollow cylindrical member having open ends and divided into first, second and third sections, the first section having a circular aperture for receiving individual containers from said customer, one at a time, in an orientation with said longitudinal axis of said container coaxial with the cylindrical member, the second section connected for movement between a first position coaxial with the first and third sections and a second position out of alignment with the first and third sections, and the third section having a discharge aperture for directing said container into contact with said shredding means; and roller means for rollingly engaging said external surface of said container as said container moves through the hollow cylindrical member, said roller means connected to said cylindrical member at equal angularly spaced locations around a periphery of said cylindrical member and extending longitudinally along a portion of the cylindrical member.

13. The apparatus of claim 11 wherein said container drive means further comprises:

an enlarged rotatably driven roller extending radially inwardly through said conveying means for engaging said external surface of said container, the driven roller disposed at an angle with respect to a plane normal to said conveying means for imparting both rotation and longitudinal movement to said container within said conveying means such that said uniform product code data follows a generally helical path between the driven roller and the second location.

14. The apparatus of claim 11 wherein said scanning means further comprises:

a scanner for reading uniform product code data at least two times from said external surface of said container while said container rotates and moves longitudinally between the spinning means and the second location.

15. The apparatus of claim 11 wherein said central processing means further comprises:

a central processing unit for comparing two output signals corresponding to two separate individual reads by said scanning means of said uniform product code data from the external surface of said container for identicalness, and if not identical, the central processing unit for sending a processed electronic output signal to actuate the ejecting means.

16. The apparatus of claim 11 wherein said ejecting means further comprises:

a moveable member for diverting rejected containers from said fixed path, the moveable member operable between a first position in line with said fixed path and a second position out of alignment with said fixed path.

17. The apparatus of claim 11 wherein said shredding means further comprises:

a pair of counter-rotating cog gears having intermeshing teeth aligned with the fixed path for shredding containers discharged at the third location, each gear having an axis of rotation generally perpendicular to and offset from the fixed path.

18. A method of redeeming returnable containers inserted by a customer, said returnable containers having a longitudinal axis and uniform product code data on an external surface, the method comprising the steps of:

transporting individual containers from a first location for customer insertion, to a second location for selective container ejection and to a third location for selective container shredding, said container transported along a fixed path aligned with said longitudinal axis of said container;

driving the uniform product code data in a generally helical path along the fixed path;

scanning uniform product code data from said external surface of said container while helically spinning along the fixed path;

sending an output signal corresponding to said scanned uniform product code data;

if uniform product code data is not sensed, ejecting said container at said second location; and if uniform product code data is sensed, shredding said container at said third location.

19. The method of claim 18 wherein said driving step further comprises the step of:

simultaneously imparting both rotational and longitudinal movement to each individual container during transport from the first location to the second location.

20. The method of claim 18 further comprising the steps of:

processing said output signal in a central processing unit in accordance with a program stored in memory; and generating a processed electronic output signal from said central processing unit to selectively actuate said ejecting step.

* * * * *